United States Patent [19]

Saliba

[11] Patent Number: 4,714,143

[45] Date of Patent: Dec. 22, 1987

[54] HANDLE AND PANEL ASSEMBLY FOR PORTFOLIO

[76] Inventor: Frank Saliba, 115 W. 30th St., New York, N.Y. 10001

[21] Appl. No.: 859,483

[22] Filed: May 5, 1986

[51] Int. Cl.[4] ..... A45C 3/02; A45C 13/22

[52] U.S. Cl. ..... 190/115; 190/900; 150/52 B; 383/14

[58] Field of Search ..... 190/115, 900; 16/110 R, 16/115 R, 125; 150/107; 52 B; 383/14

[56] References Cited

U.S. PATENT DOCUMENTS

| | | | |
|---|---|---|---|
| 14,225 | 12/1916 | Lowy | 190/115 |
| 1,446,035 | 2/1923 | Conover | 190/115 |
| 2,011,880 | 8/1935 | Stein | 190/900 X |
| 2,053,630 | 9/1936 | Plotkin | 190/115 |
| 2,069,255 | 2/1937 | Lifton | 190/115 |
| 2,096,895 | 10/1937 | Halpin | 383/97 X |
| 2,274,605 | 2/1942 | Hoffmeister | 16/110 R |
| 2,318,563 | 5/1943 | Smith | 150/107 |
| 2,628,695 | 2/1953 | Rognsvoog, Sr. | 16/125 |
| 2,769,474 | 11/1956 | Klotz | 190/900 |
| 2,803,746 | 4/1957 | Klenz | 190/900 |
| 3,016,939 | 1/1962 | Lowy | 383/14 X |
| 3,243,020 | 3/1966 | Friedlander | 16/110 R |
| 3,578,115 | 5/1971 | Schneider | 190/115 |
| 3,656,594 | 4/1972 | Marks et al. | 16/110 R |
| 4,134,480 | 1/1979 | Davis | 16/115 |
| 4,239,074 | 12/1980 | Kahn | 190/900 X |

FOREIGN PATENT DOCUMENTS

| | | | |
|---|---|---|---|
| 1319373 | 1/1963 | France | 190/115 |
| 449227 | 6/1936 | United Kingdom | 190/115 |

*Primary Examiner*—William Price
*Assistant Examiner*—Sue A. Weaver
*Attorney, Agent, or Firm*—A. A. Saffitz

[57] ABSTRACT

The invention relates to a novel handle and panel assembly in a zipper closed portfolio and in particular to an improved internally cushioned handle construction in which the inner seam of the handle is formed by sewing the front and back handle sections together and folding whereby the inner side of the handle presents a stitching line located between inner folded plies which constitute the front and back sides of the handle, respectively, and wherein the cushioning material is provided on the outer side of the handle to provide a soft reinforcement of this soft outer side thereby improving the feel of the handle as it is grasped by the fingers of the hand in carrying the portfolio. The handle is of the type which can be retracted, or moved up and down within the panel. The zipper of the portfolio constitutes the sole entry into a security compartment within the panels on the right and left sides of the portfolio. The outer seam of the handle consists of a line of stitching as in the conventional handle construction extending in a continuous line from the bottom to the top and across the top and down the other side. In contrast to conventional handles which do not have plastic foam reinforcement on the underside of the handle where the fingers engage this portion, the present handles presents an outwardly curved cross section.

3 Claims, 5 Drawing Figures

HANDLE AND PANEL ASSEMBLY FOR PORTFOLIO

CROSS REFERENCE TO RELATED APPLICATION

Reference is made to my co-pending application entitled "Hasp Lock, Zipper and Cover Assembly for Portfolio" filed on the same date as the present application.

BACKGROUND OF THE INVENTION

1. Field of the Invention

The invention is in the field of top opening portfolios having retractable handles and having a body construction of high grade, long wearing leather, preferably lined with a suitable flexible lining in which a long wearing and durable handle is provided consisting of a new inner stitched construction on the inner edge of the handle and having an internal foam plastic reinforcement to reshape the finger gripping portion at the upper part of the U-shaped handle and the form of a bottom outer curved surface.

2. Description of the Prior Art

The concept of stitching a protective covering such as a pillow casing on the inner edges which are inwardly folded is shown in the U.S. Pat. to Gartz, No. 2,291,155 in which the right and the left side panels of the pillow are folded inwardly and stitching joins these folded panels on the inside of the pillow rather than on the outside, thereby bringing the edge of the pillow to the stitching line. Although such stitching has been provided in woven fabric ticking, I am not aware that such stitching has ever been provided in a portfolio handle.

In the patent to Kahn, U.S. Pat. No. 4,239,074, a conventional pair of handles are shown which are movable downwardly in a pocket in a panel on each side of a portfolio or brief case. This handle construction in this patent has a thin cross-section which is determined by the thickness of the upper and lower parts which are stitched together in making the handles.

U.S. Pat. to Schneider, No. 3,578,115 shows a molded plastic gym bag in which the handle is simulated to show stitches on the outer edge. However, this handle is of a solid vinyl resin construction and does not have actual stitching with thread to create a line of stitching. The embossed stitching shown in the drawings of this patent is different than in the leather portfolio construction of the present invention.

In Klotz, U.S. Pat. No. 2,769,474, handles are provided which have a tiltable motion due to the attachment at the bottom of the handle and this patent shows a handle assembly different from that used in the present invention.

In Klehr, U.S. Pat. No. 2,503,746, handles are provided on each side of a bag which are movable in apertures provided in the side panels, but the present invention shows a different handle construction by virtue of the infolded stitched inner seam of the handle and the reinforcement of the outer portion of the handle by introducing synthetic foam between the center reinforcing element and the handle and the outer covering of the handle.

OBJECTS OF THE INVENTION

It is an object of the invention to provide a novel handle construction and a top opening zipper covered portfolio which is of all leather construction and is made more durable because of special inner seam stitching on the inner side of the handle and because of reinforcement by inner synthetic foam installation on the outer and lower sides of the handle within a separate covering of leather at the top of the handle.

Other and further objects will be seen from the following summary of the invention and description of the preferred embodiment and illustration in the drawings.

SUMMARY OF THE INVENTION

A three-ply leather handle of U-shape is fitted into apertures of a panel assembly which is adapted for a central opening leather portfolio in which a hidden inner stitching line is provided on the inner side of the handle and an exterior stitching line is provided on the outside of the handle joining the front and back surface coverings of the handle so that a longer lasting handle is produced which is more resistant to deterioration by moisture or perspiration. The handle can be pushed downwardly to facilitate entering the center compartment.

A further feature of the handle construction is the provision of reinforcing insulation which stretches and plumps the outer lower side of the U-shaped handle in the finger grip cover portion to thereby widen the cross-section by an amount at least equal to the cross-section of the handle in the leg portions without this plastic foam reinforcement thereby improving the grip and the comfort of the person who carries the portfolio with these handles because the outwardly curved contour of the finger grip cover portion created by plumping represents a more natural contour for the user. The handle construction is essentially formed from a three-ply laminate consisting of the outer covering elements made of high grade leather and an inner reinforcing fiberboard filler element having the same U-shaped configuration.

It is a unique characteristic of the present invention that the inner stitching on the inner edge of the U-shaped handle follows the interior leg portions and the interior top finger cover portion of the handle along two infolded edges represented by the outer and inner handle covering respectively. This inner seam is formed by a continuous stitching line along the entire interior U-shaped perimeter of the handle. The application of adhesive to the fiberboard central filler element bonds the central filler element to the folded outer leather covering element which forms both front and back covering so that the stitching on the outer edge is the only visible line of stitching and constitutes the outer seam line which is stitched through the leather panels and the fiberboard filler. The outer stitching line extends along the outer U-shaped perimeter of the handle from its lower bottom on the right hand side along the top to its lower bottom on the left hand side. A high strength thread of multifilament fibers formed by bonding high strength staple length fibers with synthetic resin is used for stitching the inner and outer edge. The stitched edges have high water resistance and very high strength and orient the edges in a very close fit.

In contrast to the narrow interior edge provided by covering the top of the U-handle with a finger grip portion, the specially plumped finger grip of the invention provided with insulation utilizes a significantly greater bottom area for the fingers along the grip portion which is stitched to the top edge portion of the handle. Effectively a pouch is provided by the additional insulation material inserted within the grip covering. The soft yieldable synthetic plastic foam is preferably polyurethane foam which is known to be water resistant, chemically inert, and resistant to oxidation. This plump outer bottom portion of the grip more than doubles the area for gripping the handle and as a result reduces the wear and distortion of the handle when heavy loads are contained within the portfolio. The introduction of the synthetic polyurethane foam improves the feel or touch of the handle in comparison with the feel of the hard bottom edge of the handle of the prior art. A seamless soft pliable rounded leather portions wears entirely differently and there are no edges to separate as in the prior art handle. Not only does the handle have a different appearance, but its characteristic contour permits it to be readily identified by the sense of touch.

DESCRIPTION OF THE PREFERRED EMBODIMENTS

Figure 1:
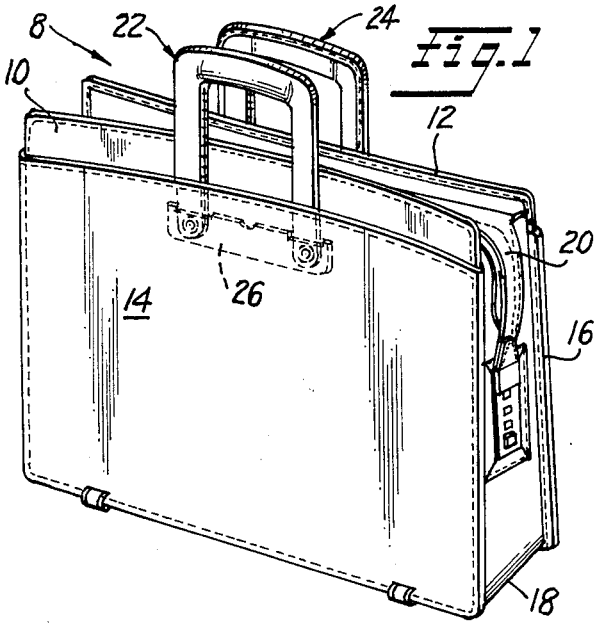
FIG. 1 is a pictorial view of a portfolio showing the carrying handles of the present invention.

In FIG. 1 there is shown a portfolio 8 which is of all leather construction having left and right sides 10 and 12 defining a center compartment which is zippered, left and right pockets 14 and 16 a bottom 18, and further having a hasp lock, zipper and cover assembly as described and shown in my co-pending application entitled "Hasp Lock, Zipper and Cover Assembly for Portfolio" filed on even date herewith as Ser. No. 06/859,484. The details of the hasp lock cover assembly and closure 20 are as set forth in said co-pending application but it should be noted that the cover assembly is stitched to the inner upper edges of the right side 12 and left side 10, respectively, and the closure constitutes the sole means for opening and closing the central compartment of the portfolio.

Figure 2:
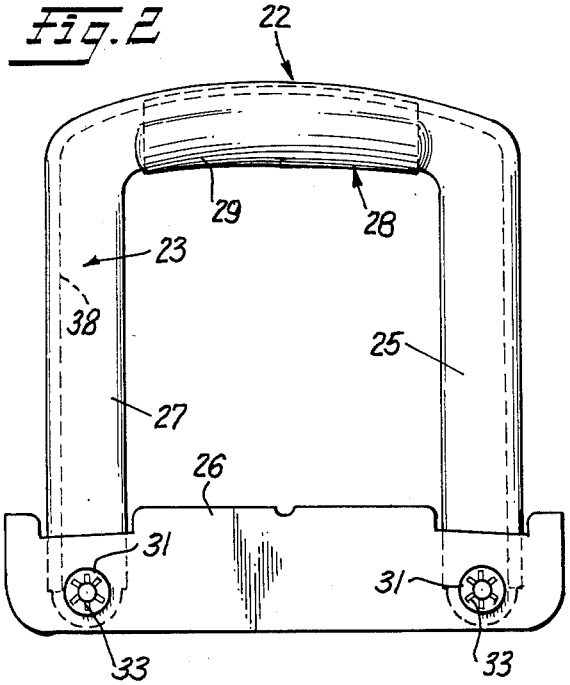
FIG. 2 is a front elevation view of one of the carrying handles of FIG. 1.
Figure 5:
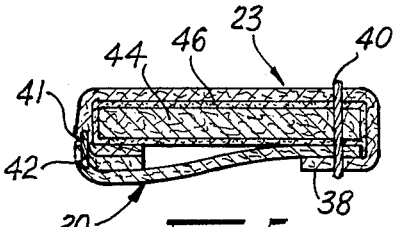
FIG. 5 is a horizontal sectional view, taken through one of the legs of the handle, taken on the line 5—5 of FIG. 3.

The handles 22 and 24 shown in FIGS. 1, 2 and 5 are in the form of an inverted U-shaped handle structure which is connected at the end of its legs to stop bar 26 so that the handle 22 or 24 or both may be slidably extended or recessed in the pocket of the cover of the portfolio, pocket 14 which is the pocket for handle 22 or pocket 16 which is the pocket for handle 24. The inner seam 41 as shown in FIG. 5 of the handle joins the cover portion 23 for the front of the handle with the cover portion 30 for the rear of the handle. The two cover portions 23 and 30 are overlapped where the inner seam 41 is formed whereby the inner edge of the inverted U handle has no appearance of any seam. A reinforcing fiberboard filler member or element 44 having the same general contour as the leg portions serves to stiffen the center of the sewn construction and the outer seam 40 shown in dotted line in FIG. 2 pierces the front and back cover portions 23 and 30 respectively. The back edge of cover 30 is cut under the hem 38 of the front wraparound portion of cover 23.

Figure 4:
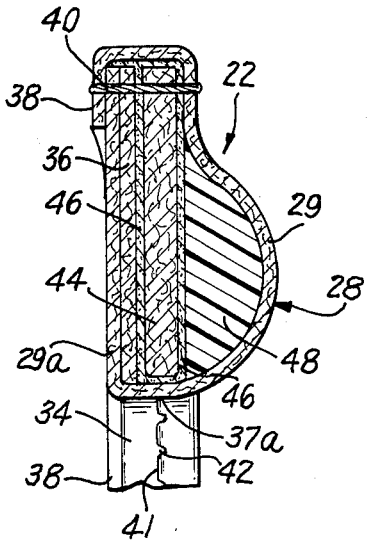
FIG. 4 is an enlarged fragmentary vertical sectional view, through the hand grasp portion, taken on the line 4—4 of FIG. 3.
Figure 3:
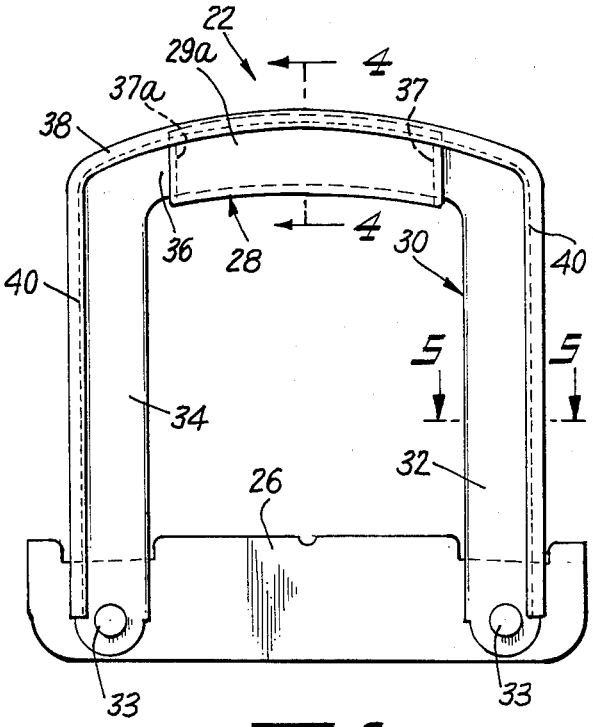
FIG. 3 is a rear elevational view of the carrying handle of FIG. 2.

The handles 22 and 24 shown in FIGS. 2, 3 and 4 are each assembled with a bottom cross piece secured by rivets 33 at the bottom, stop bar 26. As shown in FIG. 2, stop bar 26 is a thin stiff sheet cut into the form of a bar. The stiff sheet from which the stop bar is formed is vulcanized fiber which is, a plastic fibrous impregnated material of high strength and is quite stiff, comparable in stiffness to a thin steel strip. Stop bar 26 is secured to the bottom of each of the handles 22 and 24 by means of rivets 33 which are punched through the ends of the handles 22 and 24. Rivets 33 are pressed against washers 31 to create a tight fit. The stop bar 26 has a straight top edge and a straight bottom edge which is parallel to the top edge and serves the function of providing a stopping line along the entire upper edge of the stop bar 26 which meets the inner upper edge of the left pocket 14 having finished leather on the one outer side and an unfinished leather lining on the other or inner side of pocket 14. The construction of pocket 14 as well as of pocket 16 is as described in more detail in my said co-pending application filed on even date herewith and comprises an insulation sheet of synthetic plastic foam, interposed between the outer finished pocket 14 and the inner leather lining. The plastic foam sheet is polyurethane foam, in the form of a thin liner adhesively secured to the outer leather sheet forming the outer side of the pocket 14 as shown in FIG. 1. Note in FIG. 1 that the upper portion of stop bar 26 is shown in broken away section. This inner broken away section of FIG. 1 illustrates the uppermost retracted portion of handle 22. Apertures in the top edge of pocket 14 are provided for handle 22 through which the handle 22 is retracted upwardly or pushed down. The apertures in the upper edge of the pocket 14 are not shown and similar, apertures are also provided in the upper edge of pocket 16 for handle 24 in the other side of the portfolio. The edge holding these apertures has a fiberboard reinforcement which is of the same shape as the entire side 10. Thus the assembled handle 22 and stop bar 26 of the portfolio slides easily along the smooth fiberboard reinforcing panel within the side panels.

In FIG. 2 the right front leg cover 25 of the handle 22 and the left front leg cover 27 of the handle 22 share with the top of the handle a common outer line of stitching which extends from a location near rivet 33 on the left hand side upwardly around the top and downwardly on the right front leg cover 25 and near the rivet 33 on the right hand side. This stitching is best shown in cross sectional view in FIG. 4 and is seen to pass through the top from the front side to the back side and through all of the intervening elements of the handle, namely: wraparound portion 29 of the hand grasp 28, the fiberboard reinforcement element 44, the cover 30 which is the cover at the rear of the handle 22. This right rear leg cover of the cover 30 is designated by the reference numeral 32. The bight portion of the hand grasp 28 is designated by the reference numeral 36. Thus it is seen that the characteristic stitching of the outer edge shown in FIGS. 2 and 4 provides an outer layer stitching passing through all of the inner layers including cover layers and fiberboard reinforcement layers and that the retractable U-shaped handle structure is movable through apertures in the top edge of pocket 14.

Thus the reciprocating movement for the handles 22 and 24 is the same.

In FIGS. 4 and 5 the hand grasp portion 28 of handle 22 is shown in enlarged section to illustrate how the cover 23 for the front of handle 22 is stitched by means of stitches 40 to pass through the reinforcing fiber board member 44 and to secure the hem 38 at the top edge, and how the inner line of stitches 42 serves to join the inwardly folded leather edges of the cover 30, which is the cover for the rear of handle 22 so that the stitching 42 is on a side of the reinforced handle opposite to stitching 40 which forms the hem 38 (see FIG. 5). In the sectional view shown in FIG. 5 stitches 42 join the body portion of the cover for the front of handle 22, namely, cover 23, at the portion of cover 23 which lies along the inner seam 41 whereby the stitches 42 are visible through the infolded edge. Stitches 42 may be seen at the bottom portion of FIG. 4 and in particular these stitches are readily seen below the padded finger grasp portion designated by reference numeral 28 which is the hand grasp or bight portion of handle 22 in FIG. 4. The outer stitches 40 as shown in FIGS. 4 and 5 not only penetrate through cover portions 23 and hem 38 but also penetrate the fiberboard reinforcing filler member 44.

The construction of hand grasp portion 28 of handle 22 is shown in FIG. 4 is filled with a pad consisting of polyurethane foam pad 48 located on the outside of the fiberboard reinforcement element 44 and secured thereto with adhesive 46. Both sides of fiberboard reinforcement element 44 are coated with adhesive 46 and the entire assembly for the wrap around portion 29 of the hand grasp member 28 brings the mound shaped pad 48 with element 44 into adhesive and sewn engagement with the bight portion 36 of the cover 30. The back or inner side of the fiberboard reinforcement element 44 is adhered with adhesive to the bight portion 36 of cover 30.

Briefly summarizing the showing of the hand grasp portion 28 of handle 22 illustrated in FIG. 4, the essential elements comprise the wrap around portion 29 which is contoured in a mound-like protuberance to the insertions of the polyurethane pad 48, which is in turn adhesively secured to reinforcing center element 44 and the back side of which is adhesively secured to the bight portion of cover 30, the top edge having stitching by means of stitching 40 passing through the cover 29, the interposed reinforcing element 44, the back cover 30 and providing the hem portion therebelow at the back, hem 38. The inner line of stitching at inner seam 41 is provided by stitches 42 shown below the mound shaped protuberance of the hand grasp portion 28 in FIG. 4. The left rear cover of the leg at the rear of the handle 22 is designated by reference numeral 34. This left rear leg cover 34 lies in the same plane, generally speaking, as the hem and the rear surface of the handle 22. The result of this stitched and adhered construction which is created for the hand grasp portion 28 is the acheivement of a long lasting very comfortable hand grasp part of the handle which maintains its high quality appearance of finished leather, resists scruffing and is particularly designed to improve the appearance of the portfolio construction. As shown in FIG. 3 the stitches 37 for the wrap around cover portion 29 of the hand grasp portion 28 provides a line of stitching which finishes the side edges of this hand grasp portion 28 and another hand grasp portion is provided for the opposite handle 24.

Also, foot members are provided as shown in the co-pending application above mentioned, but these foot members are described and claimed in the co-pending application and are not the novelty claimed herein.

Having thus disclosed the invention, what is claimed is:

1. In a retractable inverted U-shaped handle having a bight portion, front and rear covers, and legs downwardly extending from the bight portion in combination with an outer pocket of a portfolio, said pocket having an outer finished cover, a lining, apertures in said cover and lining for said handle permitting reciprocation into said pocket between said outer cover and lining, that improvement consisting of:

a laminated hand grasp portion of said handle located at the top between the legs thereof consisting of a front cover wrap-around portion of sheet material defining a mound-like protuberance at the bottom and a rear portion of sheet material extending from said front portion;

a mound shaped pad of synthetic foam plastic which is held within said front wrap-around portion;

a flat fiberboard reinforcement element having a width slightly smaller than said hand grasp portion adhered to said pad by adhesive means;

said bight portion of said rear cover being adhesively laminated to said fiberboard reinforcement element and including an inside rear portion which provides part of the rear cover of said handle; and said front wrap-around portion and said inside rear portion being stitched together at the top outer edge of said handle by stitching passing through said fiberboard reinforcement element, said inside rear portion and both said front and rear portions.

2. A handle as claimed in claim 1 wherein the stitching of said front wrap-around portion, said inside rear portion, said rear portion and said fiberboard reinforcement element passes through said bight portion and along the legs to form a line of stitching along the outer edge of said handle and legs while the inner edge of said handle and legs is stitched with an inseam between said front cover and rear cover adjacent the inner edge of said flat fiberboard element thereby leaving only the outer line of stitching as the one visible line of stitching on the handle.

3. A handle as claimed in claim 1 wherein said plastic foam is polyurethane foam.

* * * * *